US005749489A

United States Patent [19]

Benner et al.

[11] Patent Number: 5,749,489

[45] Date of Patent: May 12, 1998

[54] PAPERBOARD CONTAINER FOR FLUIDS HAVING AN IMPROVED LOWER FITMENT RESTRAINT STRUCTURE

[75] Inventors: Christopher T. Benner, Vancouver; Nicholas Harambasic, Seattle, both of Wash.

[73] Assignee: Longview Fibre Company, Longview, Wash.

[21] Appl. No.: 598,079

[22] Filed: Feb. 7, 1996

[51] Int. Cl.[6] ..... B65O 5/56; B65O 5/74

[52] U.S. Cl. ..... 220/465; 220/410; 220/462; 229/109

[58] Field of Search ..... 229/109, 110; 220/408, 410, 416, 418, 462, 465; 222/105, 107

[56] References Cited

U.S. PATENT DOCUMENTS

| | | | |
|---|---|---|---|
| Re. 33,128 | 12/1989 | Nordstrom . | |
| 324,114 | 8/1885 | Jaeger . | |
| 1,115,060 | 10/1914 | Eaton . | |
| 3,007,608 | 11/1961 | Cox, Jr. . | |
| 3,087,655 | 4/1963 | Scholle . | |
| 3,138,293 | 6/1964 | Roak et al. . | |
| 3,169,690 | 2/1965 | Scholle . | |
| 3,206,075 | 9/1965 | Scholle . | |
| 3,219,240 | 11/1965 | Campbell, Jr. . | |
| 3,239,104 | 3/1966 | Scholle . | |
| 3,349,965 | 10/1967 | Krugger . | |
| 3,363,807 | 1/1968 | Powell . | |
| 3,937,392 | 2/1976 | Swisher . | |
| 3,972,454 | 8/1976 | Croley . | |
| 4,042,164 | 8/1977 | Croley . | |
| 4,166,567 | 9/1979 | Beach, Jr. et al. . | |
| 4,174,051 | 11/1979 | Edwards et al. . | |
| 4,359,182 | 11/1982 | Perkins, Jr. . | |
| 4,392,607 | 7/1983 | Perkins, Jr. . | |
| 4,421,253 | 12/1983 | Croley . | |
| 4,475,670 | 10/1984 | Rutter . | |
| 4,516,692 | 5/1985 | Croley . | |
| 4,524,883 | 6/1985 | Herring . | |
| 4,549,673 | 10/1985 | Kupersmit . | |
| 4,585,143 | 4/1986 | Fremow et al. . | |
| 4,623,075 | 11/1986 | Riley . | |
| 4,666,059 | 5/1987 | Nordstrom | 220/465 |
| 4,742,951 | 5/1988 | Kelly et al. | 220/410 |
| 4,771,917 | 9/1988 | Heaps, Jr. et al. . | |
| 4,850,506 | 7/1989 | Heaps, Jr. et al. . | |
| 4,930,661 | 6/1990 | Voorhies . | |
| 5,069,359 | 12/1991 | Liebel . | |
| 5,348,186 | 9/1994 | Baker . | |
| 5,353,982 | 10/1994 | Perkins et al. | 220/465 |
| 5,474,203 | 12/1995 | Baker . | |

FOREIGN PATENT DOCUMENTS

| | | |
|---|---|---|
| 1168465 | 10/1969 | Australia . |

*Primary Examiner*—Gary E. Elkins

*Attorney, Agent, or Firm*—Chernoff, Vilhauer, McClung & Stenzel

[57] ABSTRACT

A container for fluid material including an upright tubular shell having a top end and a bottom end. The shell includes upright first sidewalls having a first width and an upright second sidewall having a second width that is less than the first width. The second sidewall is interdisposed between the pair of first sidewalls. The bottom end of the shell is closed, and a flexible impervious liner with a fitment attached for emptying the liner of fluid materials is located within the shell. A lower portion of the second (narrow) sidewall defines an outer opening with a vertical dimension greater than a cross-sectional portion of the fitment to be inserted therethrough. The second (narrow) sidewall has greater resistance than the first (wide) sidewall to transverse motion, which decreases the likelihood of structural failure of the container as a result of transverse motion of fitment and associated sidewall. Accordingly, locating the outer opening in the second (narrow) sidewall decreases the likelihood that the container will fail. A bottom cap covers the bottom of the container and includes a tab constructed of solid fiberboard with an inner opening having a horizontal dimension substantially greater than the cross-sectional portion of the fitment. The vertical dimension of the inner opening is less than the vertical dimension of the outer opening so that as the fitment moves in a vertical direction it will strike the top and bottom periphery of the inner opening, instead of the outer opening, thereby reducing damage to the outer opening.

28 Claims, 5 Drawing Sheets

PAPERBOARD CONTAINER FOR FLUIDS HAVING AN IMPROVED LOWER FITMENT RESTRAINT STRUCTURE

BACKGROUND OF THE INVENTION

The present invention relates to a paperboard container for fluids, and in particular to such a container having a flexible liner with a fitment at its lower end which extends out of the container for emptying fluids therefrom.

Paperboard containers having flexible liquid impervious liners are becoming more widely used as a substitute for steel, plastic and fiber drums. Not only are paperboard containers easily disposed of in an environmentally safe manner when their use is completed, they can be shipped unassembled at a much lower cost than steel drums. Examples of such containers are disclosed in Nordstrom, U.S. Pat. No. Re. 33,128; Heaps, Jr. et al., U.S. Pat. No. 4,850,506; Heaps, Jr. et al., U.S. Pat. No. 4,771,917; and Croley, U.S. Pat. No. 4,421,253.

Heaps, Jr. et al., U.S. Pat. Nos. 4,850,506; 4,771,917 and Croley, U.S. Pat. No. 4,421,253 all disclose a corrugated paperboard container with upright outer sidewalls suitable to store and transport large quantities of fluent material. The lower portion of one of the sidewalls defines a circular outer opening to enable fluids to be emptied through a fitment attached to an internal flexible liner. Any significant transverse movement of the container while it is being moved (with or without fluids contained therein), or fluids being emptied through the fitment causes the fitment to hit against the top and bottom peripheries of the circular outer opening and damage the corrugated sidewall adjacent to the opening. As the sidewall becomes damaged it tends to crease or break, decreasing the container's strength and ability to maintain its shape when filled.

In addition, with all three containers the liner must be inserted from the top which involves reaching down the length of the container to insert the fitment. This is awkward and entails substantial time to perform.

What is desired, therefore, is a paperboard container with a lower outer opening which is less likely to result in decreasing the structural integrity of the container. Further, in order to minimize the time involved with assembly, the fitment should be quick and easy to insert from the top of the container.

SUMMARY OF THE INVENTION

The present invention overcomes the aforementioned drawbacks of the prior art by providing, in a first aspect, a container for fluid material including an upright tubular shell having a top end and a bottom end. The shell includes a pair of upright first sidewalls having a first width and an upright second sidewall having a second width that is less than the first width. The second sidewall is interdisposed between the pair of first sidewalls. The bottom end of the shell is closed, and a flexible impervious liner with a fitment attached for emptying the liner of fluid materials is located within the shell. A lower portion of the second (narrow) sidewall defines an outer opening suitable for a portion of the fitment to be inserted therethrough. The second (narrow) sidewall has greater resistance than the first (wide) sidewall to transverse motion, which decreases the likelihood of structural failure of the container as a result of transverse motion of the fitment and associated sidewall. Accordingly, locating the outer opening in the second (narrow) sidewall decreases the likelihood that the container will fail.

In another aspect of the present invention the outer opening has a vertical dimension substantially greater than the diameter of the circular cross-sectional portion of the fitment that fits within the outer opening. The relative vertical dimensions of the outer opening and fitment increase the range of vertical movement of the fitment prior to contacting the periphery of the outer opening. This reduces the damage to the outer opening as a result of the fitment's movement.

In the preferred embodiment, a bottom cap overlays a substantial portion of the bottom end of the tubular shell and includes at least one tab that defines an inner opening suitable for a portion of the fitment to be inserted therethrough. The tab is constructed of a solid fiberboard material for added strength and the inner opening has a horizontal dimension substantially greater than the diameter of the circular cross-sectional portion of the fitment. In addition, the outer opening's vertical dimension is greater than the vertical dimension of the inner opening so that the fitment will strike the top and bottom periphery of the inner opening, instead of the outer opening, in order to decrease the damage to the outer opening.

In a further aspect of the present invention the container includes an inner shell with a retaining opening proximate its lower end sized to grip the fitment. With the fitment firmly gripped, the combination of the inner shell and fitment are inserted into the outer shell, thereby properly locating the fitment at the bottom of the container without the need to reach within the container.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1:
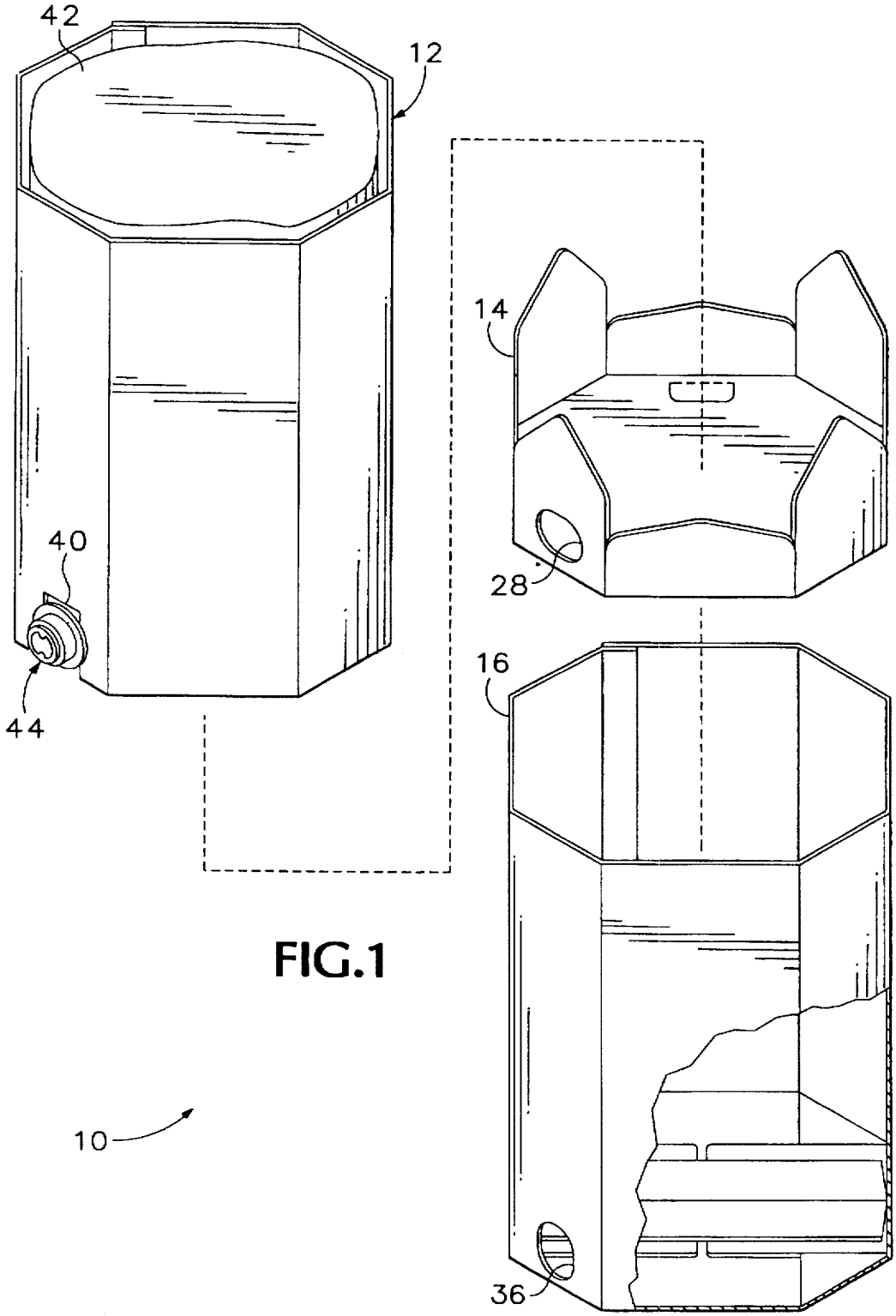
FIG. 1 is an exploded perspective view of the container embodying the present invention, including the outer shell with a portion broken away, bottom cap, inner shell, and liner with attached fitment.

Referring to FIG. 1, a container 10 is constructed of an inner shell 12, a bottom cap 14, an outer shell 16, and a reversed bottom cap (not shown) placed over an internal liner. Preferably, the shells 12, 16 and cap 14 are constructed from a fully biodegradable material, such as paperboard, which permits them to be shipped flat and recycled after the container 10 has been used. Since the shell pieces are the primary support elements for a flexible impervious liner 42 placed therein, they should be constructed from corrugated paperboard to provide maximum stiffness and structural integrity.

Figure 3:
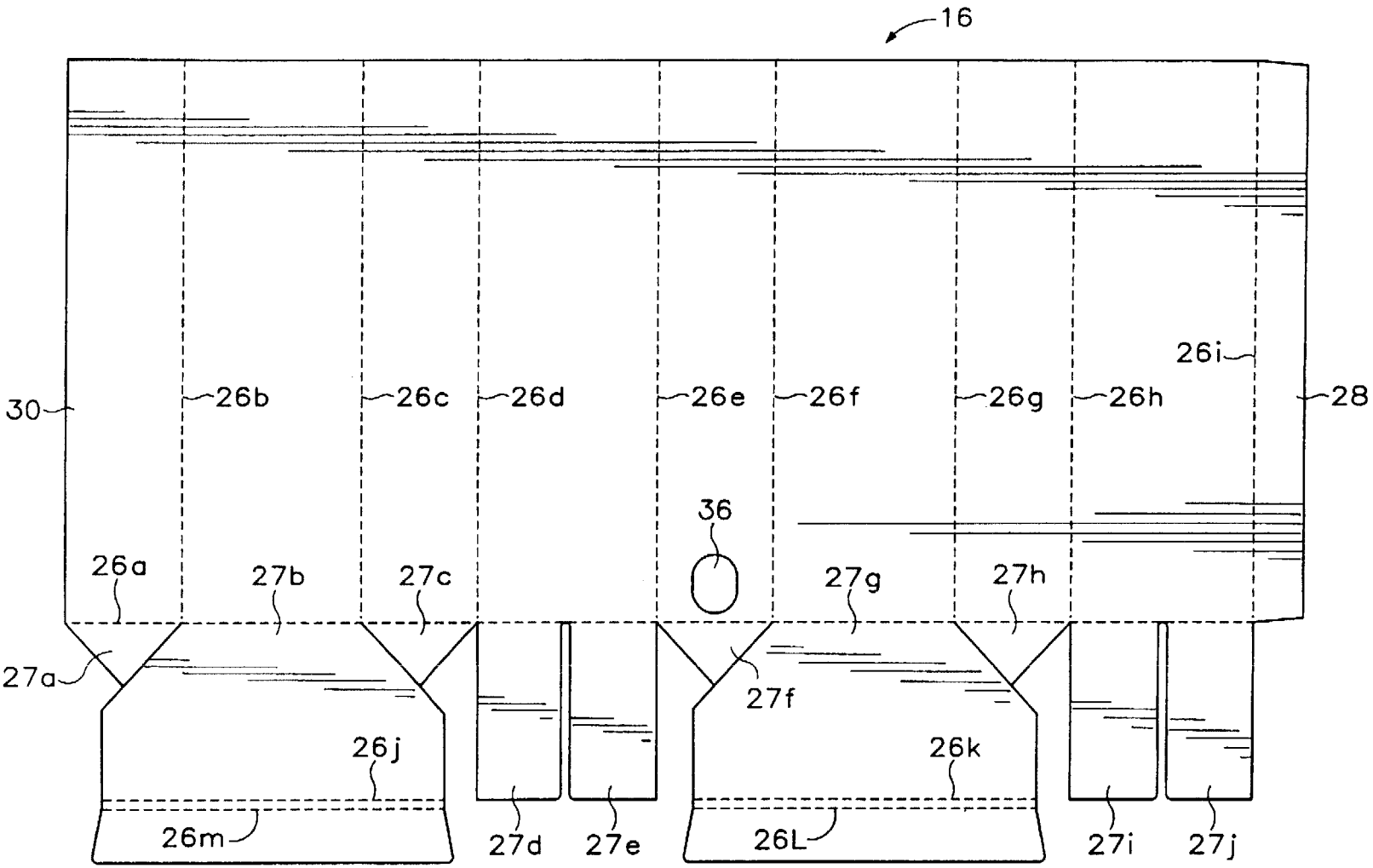
FIG. 3 is a plan view of the outer shell blank including an outer opening, as shown in FIG. 1.

Referring to FIG. 3, the outer shell 16 is made from a blank having fold lines 26*a*–26*m*. The right end portion 28 is adhered to the left end portion 30, and bottom forming flaps 27*a*–27*j* are folded together to form the bottom of the container 10, as shown in FIG. 1. The outer shell 16 also defines an outer opening 36. The bottom of the container 10 may alternatively be closed in any other suitable manner, such as, for example, with a separate cover, the bottom cap 14, or by the top of a pallet.

Figure 4:
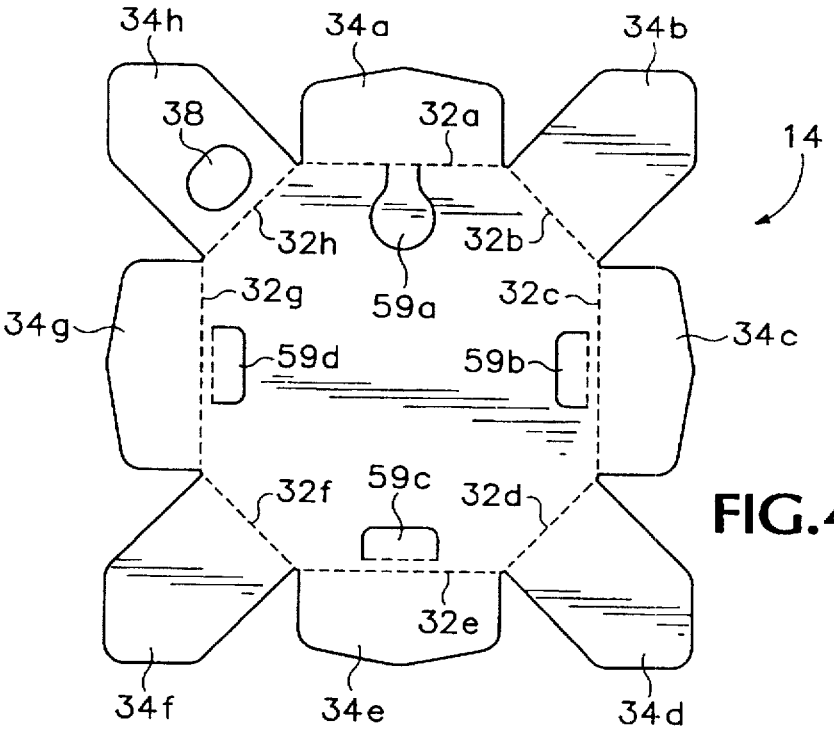
FIG. 4 is a plan view of the bottom cap blank including an inner opening, as shown in FIG. 1.

Referring to FIG. 4, the bottom cap 14 is constructed of a blank having fold lines 32*a*–32*h* each delineating a respective foldable tab 34*a*–34*h*. Tab 34*h* defines an inner opening 38. With the tabs 34*a*–34*h* folded upwardly the bottom cap 14 is slid within the outer shell 16 and the inner opening 38 is aligned with the outer opening 36. The bottom cap 14 is constructed from solid fiber paperboard.

Figure 2:
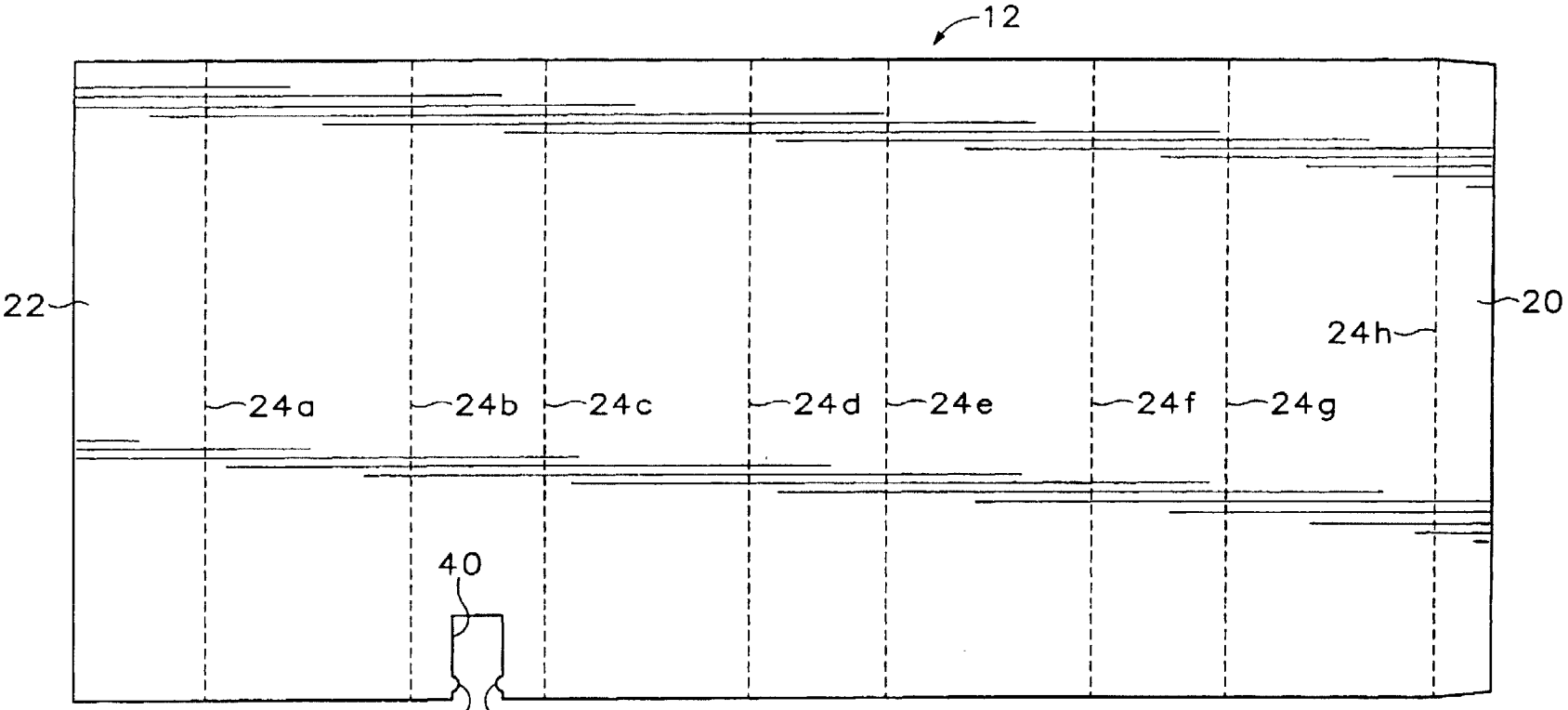
FIG. 2 is a plan view of the inner shell blank including a notch, as shown in FIG. 1.

Referring to FIG. 2, the inner shell 12 is made from a blank having fold lines 24*a*–24*h*. The left end portion 22 is adhered to right end portion 20. The inner shell 12 also defines a rectangular notch 40. The inner shell 12 is inserted within the combination of the outer shell 16 and cap 14, and the notch 40 is aligned with the openings 36 and 38. Alternatively, the notch 40 could be any other suitable shape to which a fitment 44 can be gripped by or attached to, as described later.

A liner 42 with an attached fitment 44 at its lower end is inserted within the openings 36, 38 and notch 40 in order to drain the liner 42 to the exterior of the container 10. The liner 42 material is selected to be compatible with the material which will be carried in the container 10. The liner 42 may also have a fitment at its upper end (not shown) for filling the container 10. The fitment 44 includes a locking portion 46 adjacent to the liner 42 having a rectangular cross-section. Located outwardly of the locking portion 46 is a circular cross-sectional portion 48. A circular cross-sectioned central passageway extends through the fitment 44. The outer extremity of the passageway is threaded and a cap 47 having mating threads is screwed into the passageway to close it. Fitments of this type are commercially available and are referred to in the trade as Waddington and Duvall, or Hedwin type fitments.

The fold lines 24*a*–24*h*, 26*a*–26*k*, and 32*a*–32*h* are arranged such that the assembled container 10 has a modified octagonal shape with four upright narrow sidewalls and four upright wide sidewalls. Alternatively, other polygonal or modified polygonal shapes may be used.

Traditional wisdom is that the openings 36, 38 should be located in a wide sidewall aligned adjacent to the edge of a pallet (not shown) for the convenience of attaching a valve without striking the pallet and aligning the valve with existing drain pipes. In contrast to the traditional wisdom, the openings of the present invention are located, preferably centrally, in the lower portion of one of the narrow sidewalls. Narrow sidewalls are significantly more resistant to creasing or breaking when the container is subjected to transverse motion due to moving the container 10 or emptying the liner 42. However, a container is typically arranged on the pallet with the wide sidewalls adjacent the respective edges of the pallet and the corners of the pallet extending out from under the narrow sidewalls. Accordingly, the container 10 may need to be tilted in order to obtain the necessary clearance to screw the valve into the fitment 44 without striking the pallet.

Figure 6:
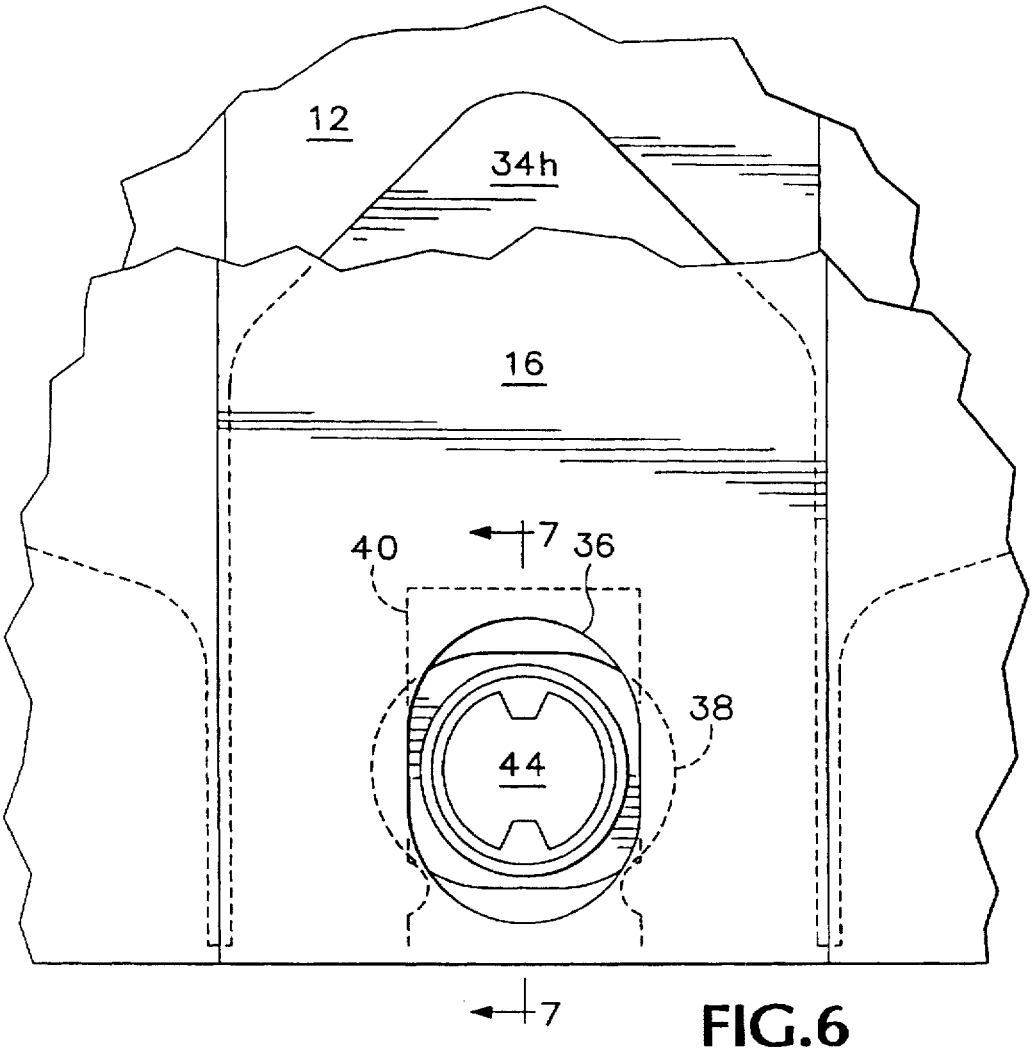
FIG. 6 is a breakaway frontal view of FIG. 1 detailing the outer opening, inner opening, fitment, and notch assembled together.
Figure 7:
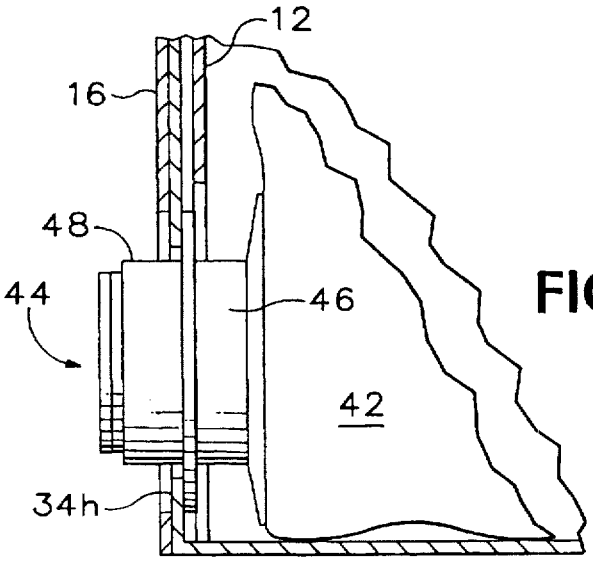
FIG. 7 is a cross-sectional view taken along line 7—7 of FIG. 6 detailing the outer opening, inner opening, fitment, notch, and liner.

The outer opening 36 has a vertical dimension that is substantially greater than the diameter of the circular cross-sectional portion 48 of the fitment 44, as shown in FIGS. 6 and 7. As the container 10 is jostled and moved, fluids in the liner 42 will move the fitment 44 primarily in a vertical direction. With the vertical dimension of the outer opening 36 substantially greater than that of the circular cross-sectional portion 48 of the fitment 44, the fitment 44 is permitted an extended range of motion without striking the periphery of the outer opening 36. If the range of fitment's 44 motion, which is primarily vertical, is normally within the outer opening 36, then the fitment 44 will not bang into the periphery of the outer opening 36. In addition, the outer opening's 36 height makes it easier to insert the fitment 44 therethrough, which is especially helpful because the outer opening is at the bottom of the container and the fitment must be manipulated from the top of the container.

Figure 5:
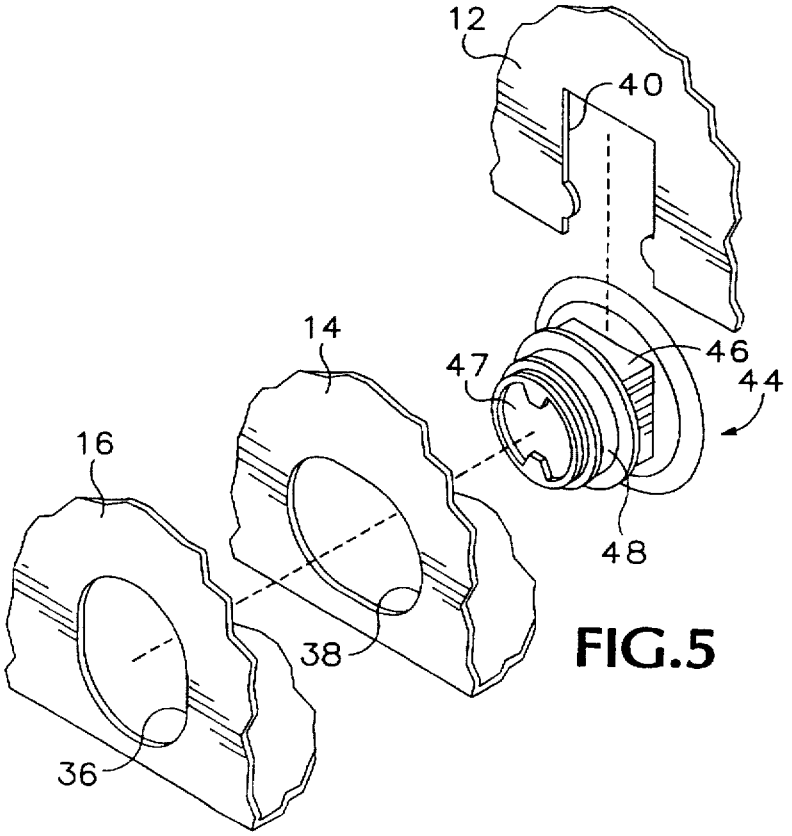
FIG. 5 is a partial breakaway exploded perspective view of FIG. 1 detailing the alignment of the outer opening, inner opening, fitment, and notch.

Referring to FIG. 5, the bottom cap 14 is preferably constructed from a solid fiberboard which is more impact resistant than corrugated fiberboard. In addition, solid fiberboard is generally thinner than corrugated fiberboard, so the gap between the edges of the bottom cap 14 and the inner and outer shells 12 and 16 is minimized. The inner opening 38 has a horizontal dimension that is substantially greater than the diameter of the circular cross-sectional portion 46 of the fitment 44, as shown in FIGS. 6 and 7. The inner opening 38 has a vertical dimension that is less than the vertical dimension of the outer opening 36 in order to limit the range of movement of the fitment 44, so the top and bottom periphery of the outer opening 36 are not damaged. In other words, the fitment 44 will strike the top and bottom periphery of the inner opening 38, as opposed to the outer opening 36, when moving in a vertical direction. Since the solid fiberboard construction of the bottom cap 14 provides superior resistance to damage from impact than corrugated paperboard, the bottom cap 14 is better able to withstand vertical movement of the fitment 44 than the outer shell 16 would be. The oblong horizontal inner opening 38, as opposed to a circular opening similar in size to the fitment 44, makes it easier to insert the fitment 44 therethrough. The bottom cap 14 may be reversed and placed over the top of the liner 42, if desired. The bottom cap 14 may alternatively be constructed from paperboard. The openings 59*b*, 59*c*, and 59*d* are provided to allow the container to be handled by standard drum handling carts. Opening 59a allows access to a top fitment to the liner 42, if any.

The inner shell 12 includes a rectangular notch 40 that has a width that closely matches the width of the rectangular engaging portion 46 of the fitment 44 so as to grip the fitment 44 and hold it in place. The notch 40 includes retaining nubs 83*a* and 83*b* to help retain the fitment 44. With the fitment 44 retained by the notch 40, the inner shell 12 is slid within the outer shell 16 and bottom cap 14. This is an efficient way to locate and properly align the combination of the fitment 44 and attached liner 42 at the lower portion of the container 10 without having to reach within the container 10 and locate the fitment 44 within the notch 40. The fitment 44 is then inserted through the outer and inner openings 36 and 38. The gripping of the fitment 44 by the inner shell 12 decreases the time required to assemble the container 10.

As mentioned above, the various elements of the container 10 of the subject invention can be shipped flat to the user so that the container can be assembled where it is to be filled.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A container for fluid materials comprising:

(a) an upright tubular shell having a top end and a bottom end, said shell including at least three upright first sidewalls having a first width and at least two upright second sidewalls having a second width that is less than said first width, each of said second sidewalls being interdisposed between a respective pair of said first sidewalls;

(b) means for closing said bottom end of said shell (c) a flexible, impervious liner located within said shell;

(d) a fitment attached to said liner for emptying said liner of fluid materials; and (e) a lower portion of said upright second sidewall defining an outer opening suitable for a portion of said fitment to be inserted therethrough.

2. The container of claim 1 wherein at least a portion of said fitment has a circular cross-section, and said outer opening has a vertical dimension substantially greater than the diameter of the circular cross-sectional portion of said fitment.

3. The container of claim 1, further comprising:

(a) a bottom cap overlying a substantial portion of said bottom end of said tubular shell;

(b) said bottom cap including at least one tab defining an inner opening suitable for a portion of said fitment to be inserted therethrough; and (c) said tab constructed of a solid fiberboard material.

4. The container of claim 1, further comprising:

(a) a bottom cap overlying a substantial portion of said bottom end of said tubular shell;

(b) said bottom cap including at least one tab defining an inner opening suitable for a portion of said fitment to be inserted therethrough; and (c) at least a portion of said fitment having a circular cross-section, and said inner opening having a horizontal dimension substantially greater than the diameter of the circular cross-sectional portion of said fitment.

5. The container of claim 1, further comprising:

(a) a bottom cap overlying a substantial portion of said bottom end of said tubular shell;

(b) said bottom cap including at least one tab defining an inner opening suitable for a portion of said fitment to be inserted therethrough;

(c) at least a portion of said fitment having a circular cross-section;

(d) said outer opening having a vertical dimension substantially greater than the diameter of the circular cross-sectional portion of said fitment; and (e) said inner opening having a vertical dimension that is less than said vertical dimension of said outer opening.

6. The container of claim 5 wherein said inner opening has a horizontal dimension substantially greater than the diameter of the circular cross-sectional portion of said fitment.

7. The container of claim 6 wherein said tab is constructed of a solid fiberboard material.

8. The container of claim 1 wherein said upright tubular shell is an upright tubular outer shell, and further comprising:

(a) an upright tubular inner shell having a top end and a bottom end, said inner shell including a plurality of side-by-side sidewalls;

(b) said inner shell including a retaining opening defined in one of said plurality of side-by-side sidewalls for tightly engaging said fitment so as to prevent rotational movement of said fitment and maintain the relative position of the combination of said fitment and said inner shell when said fitment is engaged with said inner shell; and (c) said inner shell located within said outer shell.

9. A container for fluid material comprising:

(a) an upright tubular shell having a top end and a bottom end, said shell including at least five side-by-side sidewalls, said shell defining an interior surface opposing an exterior surface that is located at the exterior periphery of said container;

(b) means for closing said bottom end of said shell;

(c) a flexible, impervious liner located within said shell;

(d) a fitment attached to said liner for emptying said liner of fluid materials, at least a portion of said fitment having a circular cross-section;

(e) an outer opening defined in one of said sidewalls that extends from said inner surface to said exterior surface and proximate said bottom end for receiving the circular cross-sectional portion of said fitment; and (f) said outer opening having a vertical dimension substantially greater than the diameter of the circular cross-sectional portion of said fitment.

10. The container of claim 9, further comprising:

(a) a bottom cap overlying a substantial portion of said bottom end of said tubular shell;

(b) said bottom cap including at least one tab defining an inner opening suitable for the circular cross-sectional portion of said fitment to be inserted therethrough; and (c) said tab constructed of a solid fiberboard material.

11. The container of claim 9, further comprising:

(a) a bottom cap overlying a substantial portion of said bottom end of said tubular shell;

(b) said bottom cap including at least one tab defining an inner opening suitable for a portion of said fitment to be inserted therethrough; and (c) said inner opening having a horizontal dimension substantially greater than the diameter of the circular cross-sectional portion of said fitment.

12. The container of claim 9, further comprising:

(a) a bottom cap overlying a substantial portion of said bottom end of said tubular shell;

(b) said bottom cap including at least one tab defining an inner opening suitable for a portion of said fitment to be inserted therethrough;

(c) said inner opening having a vertical dimension that is less than said vertical dimension of said outer opening.

13. The container of claim 12 wherein said inner opening has a horizontal dimension substantially greater than the diameter of the circular cross-sectional portion of said fitment.

14. The container of claim 13 wherein said tab is constructed of a solid fiberboard material.

15. The container of claim 9, further comprising:

(a) an upright tubular inner shell having a top end and a bottom end, said inner shell including a plurality of side-by-side sidewalls;

(b) said inner shell including a retaining opening defined in one of said plurality of side-by-side sidewalls for tightly engaging said fitment so as to prevent rotational movement of said fitment and maintain the relative position of the combination of said fitment and said inner shell when said fitment is engaged with said inner shell; and (c) said inner shell located within said outer shell.

16. The container of claim 9 wherein said plurality of side-by-side sidewalls includes at least a pair of upright first sidewalls having a first width and an upright second sidewall having a second width that is less than said first width, said second sidewall being interdisposed between said pair of first sidewalls, a lower portion of said upright second sidewall defining said outer opening.

17. A container for fluid material comprising:

(a) an upright outer tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials;

(e) an upright inner tubular shell having a top end and a bottom end, said inner shell including a plurality of side-by-side sidewalls; and (f) a retaining opening defined in one of said sidewalls of said inner shell for tightly engaging said fitment to prevent rotational movement of said fitment and maintain the relative position of said fitment and said inner shell when said fitment is engaged with said inner shell.

18. The container of claim 17, further comprising at least a portion of said fitment having a circular cross-section, an outer opening defined in one of said sidewalls of said outer tubular shell proximate said bottom end of said outer tubular shell for receiving said circular cross-section, and said outer opening having a vertical dimension substantially greater than the diameter of the circular cross-sectional portion of said fitment.

19. A container for fluid materials comprising:

(a) an upright tubular shell having a top end and a bottom end, said shell including at least a pair of upright first sidewalls having a first width and an upright second sidewall having a second width that is less than said first width, said second sidewall being interdisposed between said pair of first sidewalls;

(b) a flexible, impervious liner located within said shell;

(c) a fitment attached to said liner for emptying said liner of fluid materials;

(d) a lower portion of said upright second sidewall defining an outer opening suitable for a portion of said fitment to be inserted therethrough;

(e) a bottom cap overlying a substantial portion of said bottom end of said tubular shell;

(f) said bottom cap including at least one tab defining an inner opening suitable for a portion of said fitment to be inserted therethrough; and (g) said tab constructed of a solid fiberboard material.

20. A container for fluid materials comprising:

(a) an upright tubular shell having a top end and a bottom end, said shell including at least a pair of upright first sidewalls having a first width and an upright second sidewall having a second width that is less than said first width, said second sidewall being interdisposed between said pair of first sidewalls;

(b) a flexible, impervious liner located within said shell;

(c) a fitment attached to said liner for emptying said liner of fluid materials;

(d) a lower portion of said upright second sidewall defining an outer opening suitable for a portion of said fitment to be inserted therethrough;

(e) a bottom cap overlying a substantial portion of said bottom end of said tubular shell;

(f) said bottom cap including at least one tab defining an inner opening suitable for a portion of said fitment to be inserted therethrough; and (g) at least a portion of said fitment having a circular cross-section, and said inner opening having a horizontal dimension substantially greater than the diameter of the circular cross-sectional portion of said fitment.

21. A container for fluid materials comprising:

(a) an upright tubular shell having a top end and a bottom end, said shell including at least a pair of upright first sidewalls having a first width and an upright second sidewall having a second width that is less than said first width, said second sidewall being interdisposed between said pair of first sidewalls;

(b) a flexible, impervious liner located within said shell;

(c) a fitment attached to said liner for emptying said liner of fluid materials;

(d) a lower portion of said upright second sidewall defining an outer opening suitable for a portion of said fitment to be inserted therethrough;

(e) a bottom cap overlying a substantial portion of said bottom end of said tubular shell;

(f) said bottom cap including at least one tab defining an inner opening suitable for a portion of said fitment to be inserted therethrough;

(g) at least a portion of said fitment having a circular cross-section;

(h) said outer opening having a vertical dimension substantially greater than the diameter of the circular cross-sectional portion of said fitment; and (i) said inner opening having a vertical dimension that is less than said vertical dimension of said outer opening.

22. The container of claim 21 wherein said inner opening has a horizontal dimension substantially greater than the diameter of the circular cross-sectional portion of said fitment.

23. The container of claim 22 wherein said tab is constructed of a solid fiberboard material.

24. A container for fluid materials comprising:

(a) an upright tubular shell having a top end and a bottom end, said shell including at least a pair of upright first sidewalls having a first width and an upright second sidewall having a second width that is less than said first width, said second sidewall being interdisposed between said pair of first sidewalls;

(b) means for closing said bottom end of said shell;

(c) a flexible, impervious liner located within said shell;

(d) a fitment attached to said liner for emptying said liner of fluid materials;

(e) a lower portion of said upright second sidewall defining an outer opening suitable for a portion of said fitment to be inserted therethrough;

(f) said upright tubular shell is an upright tubular outer shell;

(g) an upright tubular inner shell having a top end and a bottom end, said inner shell including a plurality of side-by-side sidewalls;

(h) said inner shell including a retaining opening defined in one of said plurality of side-by-side sidewalls for tightly engaging said fitment so as to prevent rotational movement of said fitment and maintain the relative position of the combination of said fitment and said inner shell when said fitment is engaged with said inner shell; and (i) said inner shell located within said outer shell.

25. A container for fluid material comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials, at least a portion of said fitment having a circular cross-section;

(d) an outer opening defined in one of said sidewalls proximate said bottom end for receiving the circular cross-sectional portion of said fitment;

(e) said outer opening having a vertical dimension substantially greater than the diameter of the circular cross-sectional portion of said fitment;

(f) a bottom cap overlying a substantial portion of said bottom end of said tubular shell;

(g) said bottom cap including at least one tab defining an inner opening suitable for a portion of said fitment to be inserted therethrough;

(h) said inner opening having a horizontal dimension substantially greater than the diameter of the circular cross-sectional portion of said fitment.

26. A container for fluid material comprising:

(a) an upright tubular shell having a top end and a bottom end, said shell including a plurality of side-by-side sidewalls;

(b) a flexible, impervious liner located within said shell;

(c) a fitment attached to said liner for emptying said liner of fluid materials, at least a portion of said fitment having a circular cross-section;

(d) an outer opening defined in one of said sidewalls proximate said bottom end for receiving the circular cross-sectional portion of said fitment;

(e) said outer opening having a vertical dimension substantially greater than the diameter of the circular cross-sectional portion of said fitment;

(f) a bottom cap overlying a substantial portion of said bottom end of said tubular shell;

(g) said bottom cap including at least one tab defining an inner opening suitable for a portion of said fitment to be inserted therethrough;

(h) said inner opening having a vertical dimension that is less than said vertical dimension of said outer opening; and (i) said inner opening has a horizontal dimension substantially greater than the diameter of the circular cross-sectional portion of said fitment.

27. The container of claim 26 wherein said tab is constructed of a solid fiberboard material.

28. A container for fluid material comprising:

(a) an upright tubular shell having a top end and a bottom end, said shell including a plurality of side-by-side sidewalls;

(b) means for closing said bottom end of said shell;

(c) a flexible, impervious liner located within said shell;

(d) a fitment attached to said liner for emptying said liner of fluid materials, at least a portion of said fitment having a circular cross-section;

(e) an outer opening defined in one of said sidewalls proximate said bottom end for receiving the circular cross-sectional portion of said fitment;

(f) said outer opening having a vertical dimension substantially greater than the diameter of the circular cross-sectional portion of said fitment;

(g) an upright tubular inner shell having a top end and a bottom end, said inner shell including a plurality of side-by-side sidewalls;

(h) said inner shell including a retaining opening defined in one of said plurality of side-by-side sidewalls for tightly engaging said fitment so as to prevent rotational movement of said fitment and maintain the relative position of the combination of said fitment and said inner shell when said fitment is engaged with said inner shell; and (i) said inner shell located within said outer shell.

* * * * *